United States Patent [19]

Hart

[11] 4,153,745

[45] May 8, 1979

[54] SWEAT RESISTANT GAS PROTECTIVE MATERIAL

[75] Inventor: John A. Hart, Kanata, Canada

[73] Assignee: Her Majesty the Queen in right of Canada, Ottawa, Canada

[21] Appl. No.: 873,525

[22] Filed: Jan. 30, 1978

[51] Int. Cl.[2] ..... B05D 5/00

[52] U.S. Cl. ..... 427/244; 2/2; 2/2.5; 428/306; 428/310; 428/311

[58] Field of Search ..... 2/2, 46; 428/310, 311, 428/315, 425, 253, 323, 306; 427/244; 55/316, 387, 524, DIG. 16

[56] References Cited

FOREIGN PATENT DOCUMENTS 878560 8/1971 Canada ..... 428/311

*Primary Examiner*—William J. Van Balen

*Attorney, Agent, or Firm*—Stevens, Davis, Miller & Mosher

[57] ABSTRACT

A method is described of minimizing the adverse effects of sweat and sebum on a flexible porous material which is permeable to air and water vapor but resistant to passage therethrough of noxious chemicals in liquid or vapor form. The flexible porous material is, for instance, a laminated fabric material comprising an air- and water vapor-permeable open cell solid resin foam bonded to an air and water vapor-permeable fabric backing, within which foam is dispersed and bonded a particulate adsorbent material for the noxious chemicals, e.g. activated carbon. The aforesaid flexible porous material is protected from deterioration by exposure to sweat and sebum by treating it with a liquid organic polymeric water- and oil-repellent substance, preferably a fluorochemical, which is compatible with any substances used to disperse or bind the adsorbent material in the flexible porous material, and which is of a type which does not reduce to any significant extent the adsorptive capacity of the adsorbent, e.g. activated carbon.

4 Claims, No Drawings

SWEAT RESISTANT GAS PROTECTIVE MATERIAL

This invention relates generally to materials which, while relatively permeable to air and water vapor, are resistant to the passage of noxious undesirable chemicals in the form of liquids and condensible vapors and gases. More particularly, the invention relates to the protection of such materials, and in particular gas protective clothing, from deterioration by exposure to sweat and sebum.

For protection against noxious chemicals such as the gases and smokes employed in chemical warfare, and also against dangerous chemicals such as industrial poisons and pesticides which are generally in the form of sprays or mists, it is customary to use protective equipment and in particular protective clothing which incorporates a gas and vapor adsorbent material. Garments have been provided which are made from fabric which is sufficiently permeable to air and water vapour to permit their use by humans with some degree of comfort for a reasonable period and at the same time provide protection from the undesirable effects of noxious chemicals such as chemical warfare agents. Such garments are described, for example, in British Pat. No. 575,379 issued Feb. 15, 1946 to Kingan, and U.S. Pat. No. 2,984,584 issued May 16, 1961 to Glarum. In these patents woven and non-woven fabrics are impregnated with an adsorbent such as finely divided carbon which is held in place on the textile fibres by a polymeric binder.

The prerequisites of an ideal gas-proofed material, in particular for use as wearing apparel, are as follows: The material should be such that it adsorbs a relatively large portion of noxious chemicals such as chemical warfare agents while permitting oxygen or air to pass through; the supporting material for the adsorbent should be substantially porous in order to permit perspiration or other liquids to evaporate from the wearer's body; the material comprising the support should substantially retain its flexibility after being combined with the gas adsorbent; and the gas adsorbent should be substantially permanently bound to the supporting material in order to prevent the adsorbent from becoming dislodged from the support by rain, laundering or rough usage or by the softening effect of moisture and perspiration. Finally the gas-proofed material should be capable of reuse after decontamination.

In Canadian Pat. No. 878,560 of J. A. Hart, issued Aug. 17, 1971, an air and water vapour permeable open cell solid resin foam resistant to passage therethrough of noxious chemicals in liquid or vapor form, in which there is dispersed a particulate adsorbent material for said noxious chemicals, and laminated fabric materials, e.g. in the form of protective clothing, incorporating said foam, are described. The particulate adsorbent material is bonded in said foam by an organic binder which is substantially free from substances which would substantially deactivate the adsorbent. The laminated fabric materials described in this patent include an air and water vapor-permeable fabric backing to which the aforesaid foam is bonded.

The adsorbent material in particulate form may be any solid particulate material capable of adsorbing the noxious chemicals. Such adsorbent materials are well known per se in the art and include, for example, silica gel and active clays of the attapulgite and bentonite classes, e.g. fuller's earth. A particularly preferred adsorbent material is activated carbon.

As pointed out in the aforesaid Canadian Pat. No. 878,560, flexible foams do not per se possess high mechanical strength so that, for use in garments, it is the customary practice to bond, i.e. laminate, the foam, in known manner, to a fabric, such as a knitted or woven textile material, for example, nylon tricot, cotton sheeting, canton flannel, poplin, percale, etc. in order to provide a reinforced material. Instead of loose knit or woven fabrics, non woven fabrics such as netting or scrim may also be used to reinforce the foam. If the reinforcing fabric is also impregnated some additional resistance may be obtained in view of the additional adsorbent employed; however this effect is usually minimal. The fabric is essentially for mechanical reinforcement and is bonded to the foam by known lamination techniques such as flame lamination, adhesive lamination, stitch bonding and quilting.

The preferred foams for use in the aforesaid laminated textile materials are flexible polyurethane foams such as those of the polyester and polyether types. However flexible foams of cellulose, polystyrene, vinyl polymers or polyesters may also be employed if desired.

The chemical warfare protective clothing adopted by the Canadian Armed Forces is based upon the activated carbon impregnated polyurethane foam and laminated textile materials incorporating this foam, described in the aforesaid Canadian Pat. No. 878,560 entitled "Gas Resistant Foam Material". In common with all chemical protective clothing materials in which activated carbon is the effective component, it is subject to degradation in performance due to the action of sweat and sebum. Practical trials have shown that the useful life of chemical protective clothing is limited more by the adverse effect of sweat on the gas adsorptive capacity of the activated carbon adsorbent, than by the effects of wear and tear on the clothing. The adverse effect of sweat - often referred to as sweat-poisoning is apparent even when the protective clothing is worn in temperate climatic conditions together with a gas mask and auxiliary protection for hands and feet, since the metabolic heat generated by moderate activity is not fully dissipated, but induces sweating.

The components of sweat which are adsorbed by activated carbon and thus degrade its ability to scavenge gases and vapours are the organic substances of which urea and salts of lactic acid form the greater part. The inorganic salts, although present in larger quantities, do not have so great an effect as the organic substances, but do contribute to the degradation of the carbon unless denied access.

The present invention seeks to reduce or eliminate the adverse effect of sweat on the gas scavenging property of activated carbon in clothing materials by use of a liquid repellent treatment to prevent access of sweat to the activated carbon. It is necessary to preserve the porous structure of the clothing material so that gases and vapours may have free access to the adsorption sites on the activated carbon or other adsorbent while restraining the movement of liquid sweat.

This can be achieved by applying as a thin film on the surfaces of the porous material, a substance for which water and other liquid has little affinity and does not wet. Such substances are commonly used for rendering various porous materials such as textiles, paper and leather resistant to the penetration of liquids.

The present invention, in its broadest aspect, resides in a method of minimizing the adverse effects of sweat and sebum on a flexible porous material which is permeable to air and water vapor but is resistant to passage therethrough of noxious chemicals in liquid or vapor form, said material containing a particulate adsorbent material for said noxious chemicals, which method comprises treating said flexible, porous material with a liquid organic polymeric water-and oil-repellant substance which is compatible with any substances employed to disperse or bind said particulate adsorbent material in said flexible porous material and being of a type which does not reduce to any significant extent the adsorptive capacity of said adsorbent.

In a more particular aspect, this invention resides in a method of minimizing the adverse effect of sweat and sebum on a laminated fabric material comprising an air-and water vapor-permeable open cell solid resin foam resistant to passage therethrough of noxious chemicals in liquid or vapor form, the foam having dispersed therein a particulate adsorbent material for the noxious chemicals, which particulate adsorbent material is bonded in said foam by an organic binder substantially free from substances which would substantially deactivate said adsorbent material, and an air and water vapor-permeable fabric backing to which the foam is bonded. This method comprises treating said air-and water vapor-permeable laminated material with a liquid organic polymeric water-and oil-repellant substance which is compatible with said organic binder, and which is of a type which does not reduce to any significant extent the adsorptive capacity of said adsorbent.

More particularly, the present invention resides in a method as described above, but in which the repellent substance is one which contains a high proportion of perfluorocarbon chains in the molecule.

In a further aspect, this invention resides in a flexible porous material permeable to air and water vapor but resistant to passage therethrough of noxious chemicals in liquid or vapor form, said material containing a particulate adsorbent material for said noxious chemicals, and being further characterized by being resistant to deactivation by sweat and sebum of said particulate adsorbent material, said flexible porous material being treated with a liquid organic polymeric water-and-oil-repellent substance, said repellent substance being compatible with any substances employed to disperse or bind said particulate adsorbent material in said flexible porous material and being of a type which does not reduce to any significant extent the adsorptive capacity of said adsorbent.

It is essential that the liquid repellent substance used does not seriously reduce the adsorptive capacity of the activated carbon or other adsorbent. This is an important practical limitation since most of the known liquid repellent substances used in treatment of fabrics, paper, leather, etc. are adsorbed by activated carbon and block some or all of the adsorption capacity which is then not available for adsorption of gases.

A suitable repellent substance is of polymeric nature and of molecular size such that its molecules cannot penetrate into the internal pores of the charcoal in which gas adsorption takes places.

It is also desirable that the repellent substance creates a surface with the lowest possible affinity for liquid sweat for the residue of organic and inorganic substances left when sweat dries, or for the oily substances of sebum which normally accompany sweat.

Of all the liquid repellant substances known to the water-proofing art, it is chiefly those containing a high proportion of perfluorocarbon chains which create a surface of sufficiently low energy as to repel oils, as well as the residue from sweat dried upon the clothing and freshly secreted liquid sweat. Because of this property they are the preferred repellents for exclusion of sweat and the oily exudations from the skin. They may be applied to the activated carbon impregnated fabric by impregnation or coating from dispersion in water or organic solvents as for example by using a padding mangle. The repellents may also be mixed into the dispersion of activated carbon used to impregnate the fabric, which in the preferred case is a polyurethane foam bonded to a textile. They may be applied to the activated carbon impregnated fabric by impregnation or coating from dispersion in water as for example by using a padding mangle or organic solvents. The preferred and most effective method is to mix one repellent as an aqueous dispersion with the activated carbon dispersion, and after impregnation with this mixture and subsequent drying, to apply a second repellent dissolved in an organic solvent by a second impregnation operation. The water repellency created by the first treatment renders it impossible to wet the material sufficiently well to impregnate a second time with an aqueous fluid. An organic solvent with sufficiently low surface tension is required.

A variety of fluorochemical oil and water repellent compounds suitable for use in the present invention are known and are commercially available. One particular group of fluorochemical oil repellents are the polymers obtained by polymerizing an ethylenically unsaturated fluorochemical compound. The ethylenic unsaturation may be either in the alcohol or the acid portion of the ester molecule. Typically, the unsaturated radical in the alcohol portion of the ester may be the allyl radical or the vinyl radical. Typical unsaturated acids used to prepare the ester include acrylic acid, methacrylic acid and crotonic acid. In general, the perfluoro portion of the molecule should be in the saturated portion of the molecule. The unsaturated portion of the molecule is preferably not fluorinated in each instance. The acid and alcohols radicals may suitably contain from 2 to 6 carbon atoms excluding the carbonyl carbon of the acid. Examples of such monomers include vinyl perfluorobutyrate and perfluorobutyl acrylate. These monomers may be polymerized as homopolymers or as copolymers by normal emulsion polymerization techniques using free radical catalysts.

Some of these repellents are disclosed in an article by E. J. Grajeck and W. H. Petersen appearing in *The Textile Research Journal,* April, 1962, pp. 320–331, entitled "Oil and Water Fluorochemical Finishes for Cotton".

Examples of suitable fluorochemical repellents are those known and sold under the trademarks "Scotchgard FC 208", "Scotchgard FC 210", "Scotchgard FC 232", and Scotchgard FC 319", manufactured by the 3M Company, "Zepel B" manufactured by E. I. DuPont de Nemours and Co. and "Tinotop T-10" manufactured by Ciba-Geigy Ltd.

Of these materials "Scotchgard FC 208" is an aqueous nonionic emulsion containing approximately 28% by weight of a modified fluorinated acrylic polymer: a substance believed to be of the following approximate general formula:

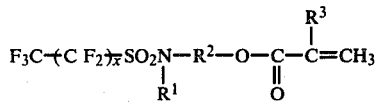

in which X is a value between 3 and 13 inclusive, $R^1$ is lower alkyl, such as methyl, ethyl, propyl, and the like, having 1–6 atoms $R^2$ is alkylene containing 1–12 carbon atoms and $R^3$ is H, methyl or ethyl. The product "Zepel" is also available in emulsion form and while it is chemically different from the "Scotchgard" products, it is a fluorochemical oil repellent containing fluorocarbon tails composed of $CF_2$ groups which may end in a terminal $CF_3$ group.

"Scotchgard FC-319" is a solution of a compound similar to "FC-208" in an organic solvent. "Scotchgard FC-232" is a dispersion of a fluorochemical resin in a mixture of water and methyl isobutyl ketone. "Zepel B" is an aqueous cationic dispersion of a fluorochemical resin and is a product of E. I. Dupont de Nemours and Company. The exact compositions of these products are not known to this applicant but they fall within the classes of compounds disclosed in the following patent specifications:

British Pat. No. 971,732, E. I. Dupont de Nemours & Co.

Canadian Pat. No. 942,900, E. K. Kleiner (Ciba-Geigy Co.)

Canadian Pat. No. 697,656, R. W. Fasick et al (Dupont)

French Pat. No. 1,568,181, H. Stockman (National Starch & Chemical Co.)

U.S. Pat. No. 2,803,615, A. H. Ahlbrecht et al (3M Co.)

U.S. Pat. No. 2,826,564, F. A. Bovey et al (3M Co.)

U.S. Pat. No. 2,642,416, A. H. Ahlbrecht et al (3M Co.)

U.S. Pat. No. 2,839,513, A. H. Ahlbrecht et al (3M Co.)

U.S. Pat. No. 2,841,573, A. H. Ahlbrecht et al (3M Co.)

U.S. Pat. No. 3,484,281, R. A. Guenther et al (3M Co.)

U.S. Pat. No. 3,462,296, S. Raynolds et al (Dupont)

U.S. Pat. No. 3,636,085, E. K. Kleiner (Ciba-Geigy)

U.S. Pat. No. 3,594,353, E. Domba (Nalco Chemical Co.)

French Pat. No. 1,562,070, P. Sherman (3M Co.)

German Pat. No. 1,419,505, E. Langerak (Dupont)

U.S. Pat. No. 3,256,230, R. E. Johnson et al (Dupont).

For application of fluorochemicals from organic solvents the choice of solvent is limited by the solubility characteristics of the fluorochemical. In general, suitable fluorochemical polymers are soluble in chlorinated or fluorinated hydrocarbons or in mixtures with other solvents such as esters, ketones and aromatic hydrocarbons.

Although the best results will be obtained by using fluorochemical repellents, a lesser degree of resistance to sweat poisoning could be obtained with other repellents. One example of a suitable repellent in which the repellent function is due to hydrocarbon side groups instead of perfluorocarbon side groups is the polymer of n-octyl methacrylate or of 2 ethylhexyl methacrylate. Such polymers can be incorporated with an aqueous dispersion of activated carbon when prepared as an aqueous emulsion, or in solution with a dispersion of activated carbon in an organic solvent. They may also be applied in solution to a fabric previously impregnated with activated carbon. Silicone resins may also be employed in some instances. The essential requirements are that the substance used creates a sweat repellent surface and that it does not cause substantial deactivation of the activated carbon.

To make the process work successfully the repellent must be an effective one, and it must be applied (either together with the activated carbon or as a second step) in sufficient quantity to be effective in creating a surface which sweat does not wet. The repellent substance must also be compatible with other substances employed for the purposes of dispersing or binding the activated carbon. Thus if an anionic latex of a binder resin is used a cationic dispersion of repellent would not be compatible, but an anionic or nonionic dispersion could be used.

The present invention will now be further described, with reference to tests which have been conducted. These tests show that the method of the present invention is effective in reducing the adverse effects of sweat and sebum on the adsorptivity of adsorbent materials contained in laminated textile materials as previously described.

Sweat was collected from men exercising in garments impervious to the passage of gases and vapors by centrifuging sweak-soaked cotton underwear. It was applied to the chemical barrier material in a tray, worked into the fabric by means of a roller squeegee, and then allowed to evaporate in situ. This procedure was repeated as many as twenty times until the weight of sweat solids accumulated amounted to at least the weight of the activated charcoal present. The adsorptive capacity of the material was measured by the amount of carbon tetrachloride adsorbed from vapour at 32 torr.

Increased water-repellency was obtained by:

(a) increasing the binder/activated charcoal ratio, (b) applying a fluorochemical repellent by over-padding from aqueous dispersion ("FC 208") or organic solvent solution ("Tinotop T-10"), (c) adding a fluorochemical repellent ("FC 208") as part of the binder for the activated charcoal, (d) adding "FC 208" as part of the binder for the activated charcoal and over-padding with "Tinotop T-10" in trichloroethylene solution.

The effectiveness of repellent treatment in preventing wetting by sweat was in the order $a<b<c<d$. Some reduction in sweat poisoning was found for all treatments in one experiment or another, but the results were very variable. The variability was attributed to the practical difficulty of applying sweat evenly to material which is not readily wettable. It was obvious that the effect of mechanical action in working sweat into the material was a critical factor. The material with a double fluorochemical treatment (d) was extremely repellent when dipped into water or sweat. When removed it remained dry but water could be forced into the pores of the material by mechanical action.

Thought was given to devising a technique for application of sweat to simulate the accumulation of sweat in clothing during wear, with the eventual conclusion that the factors involved were too complex and that tests in actual wear were necessary to determine whether repellency was effective.

A few trials were made in which swatches of fabric were worn against the skin on the lower back of men dressed in chemical warfare (CW) protective clothing and walking on a tread-mill under conditions which produced copious sweating. Material with the double repellent treatment (d) was compared with normal material without repellent after being worn for 20 periods of one hour each day. Results are shown in Table I.

Table 1

Comparison of Water Repellent Treated Material with Untreated Material after Wearing

| Material | Loss of charcoal adsorptive capacity, (percent) | Sweat solids accumulated, ($g/m^2$) |
|---|---|---|
| Normal | 37.9 | 23.8 |
| | 38.8 | 17.1 |
| | 25.4 | 20.6 |
| | 26.9 | 14.1 |
| Repellent treated | 12.7 | 9.4 |
| | 20.2 | 11.1 |
| | 14.2 | 4.4 |
| | 11.6 | 6.9 |

The following examples demonstrate the effectiveness of fluorochemical treatment of laminated textile materials impregnated with activated carbon, in providing oil and water repellancy.

EXAMPLE I

Preparation of Activated Carbon Dispersion 100 grams of "Activated Carbon Type BPL" (a trademark of Pittsburgh Chemical Company) was ground to a mass median diameter of 6 microns and dispersed by stirring into a solution of 3 grams of the ammonium salt of a styrene-maleic anhydride copolymer (having a molecular weight of 2500) in 147 grams of water.

EXAMPLE 2

Preparation of Fluorochemical Resin Dispersion 7.14 grams of "Scotchgard FC 208" was added to 100 grams of an aqueous solution containing 0.85 grams of medium viscosity carboxymethyl cellulose and 0.15 grams of high viscosity carboxymethyl cellulose. "Scotchgard FC 208" (trade-mark of the 3M Company) is a fluorochemical resin emulsion containing 28% solids and which is known to impart oil and water repellency to textile fabrics. The solution of carboxymethyl cellulose was stirred vigorously as the "FC 208" was added slowly in a steady stream. A finely divided precipitate of the fluorochemical resin was formed, was uniformly dispersed in, and remained suspended in the carboxymethyl cellulose solution. Suitable grades of carboxymethyl cellulose have substitution ranges of 0.65 to 0.85, viscosity of 10–20 centipoises in 2% aqueous solution at 25° C. for the medium viscosity grade, and viscosity of 1000–2800 centipoises in 1% aqueous solution at 25° C. for the high viscosity grade.

EXAMPLE 3

The fluorochemical resin dispersion of Example 2 was added, with stirring, to the activated carbon dispersion of Example 1. Finally, 40 grams of "Hycar 2671" was added to form a stable dispersion which was used to impregnate fabric as set forth in subsequent examples. "Hycar 2671" (trade-mark of B. F. Goodrich Co.) is an emulsion of an acrylic ester elastomer containing 50% solids.

EXAMPLE 4

The impregnating bath of Example 3 was used to saturate a polyester type polyurethane open cell flexible foam, 5/32" in thickness 100–110 cells per inch, weight 1.7 oz/sq. yd., laminated by the flame bonding process to a nylon tricot of 40 denier yarn, 36 wales and 42 courses per inch and weighing 2.0 oz/sq. yd. Excess liquid was removed by passing the laminate through the squeeze rolls of a padding mangle. The laminate was then heated to 150° C. for 10 minutes to cure the binder. The impregnated fabric was repellent to water and to oil. Drops of water placed on the fabric did not wet the fabric but stood on the surface, small drops being nearly spherical, thus showing a high contact angle. When tested for oil repellency by the Hydrocarbon Resistance Test 118–1966 of the American Association of Textile Chemists and Colorists a rating of 4 was found. This indicates a high level of repellency against hydrocarbon liquids.

EXAMPLE 5

The impregnated fabric of Example 4 was impregnated by saturating with a solution of 6% by weight of "Tinotop T-10" in trichloroethylene. "Tinotop T-10" (trade-mark of Ciba-Geigy Corporation) is a solution of a fluorochemical resin composition in a chlorinated hyrocarbon solvent and is known to impart oil and water repellent properties to textile fabrics. Excess liquid was removed by passing the fabric through the squeeze rolls of a padding mangle. The fabric was air-dried to remove solvent. The water repellency of the fabric was increased by this treatment. When dipped into water to a depth of 2 inches and removed the fabric remained dry. When tested for oil repellency by the AATCC Hydrocarbon Resistance Test 118-1966 a rating of 7 was found.

The embodiments of the invention in which an exclusive property or privilege is claimed are defined as follows:

1. A method of minimizing the adverse effect of sweat and sebum on a laminated fabric material comprising an air- and water vapor-permeable open cell flexible polyurethane foam resistant to passage therethrough of noxious chemicals in liquid or vapor form, said foam being bonded to an air- and water vapor-permeable fabric backing, said foam having dispersed therein particulate activated carbon adsorbent material for the noxious chemicals, which particulate adsorbent material is bonded in said foam by an organic binder substantially free from substance which would substantially deactivate said adsorbent material, and an air- and water vapor-permeable fabric backing to which the foam is bonded, which method comprises:

impregnating the adsorbent material with a first liquid organic polymeric water- and oil-repellent substance containing a high proportion of perfluorocarbon chains, said repellant substance being compatible with said organic binder and being of a type which does not reduce to any significant extent the adsorptive capacity of said adsorbent, said impregnating occurring by mixing as an aqueous dispersion said activated carbon adsorbent material and said repellant substance;

applying said aqueous dispersion of activated carbon adsorbent material and repellant substance to the laminated fabric material thereby impregnating the adsorbent material within the foam;

drying the impregnated laminated fabric material;

dissolving in an organic solvent a second organic polymeric water- and oil-repellant substance, different from said first substance, but also containing a high proportion of perfluorocarbon chains, being compatible with the organic binder, and being of a type which does not reduce to any significant extent the adsorptive capacity of the adsorbent; and applying the organic solvent-repellent solution to the dried impregnated laminated fabric material.

2. A method as in claim 1, wherein the repellent substance is an aqueous nonionic emulsion containing approximately 28% by weight of a modified fluorinated acrylic polymer.

3. A method as in claim 1, wherein the repellent substance is an aqueous cationic dispersion of a fluorochemical resin.

4. A method as in claim 1 wherein the organic solvent is perchloroethylene.

* * * * *